US007617777B2

(12) United States Patent
Bossarte et al.

(10) Patent No.: US 7,617,777 B2
(45) **Date of Patent: *Nov. 17, 2009**

(54) PRECISION PYROTECHNIC DISPLAY SYSTEM AND METHOD HAVING INCREASED SAFETY AND TIMING ACCURACY

(75) Inventors: George Bossarte, Cambridge, MA (US); Glenn W. Dillon, Upton, MA (US); Paul R. McKinley, Natick, MA (US); Wayne C. Haase, Acton, MA (US); Larry G. Nelson, Webster, MA (US)

(73) Assignee: MagicFire, Inc., Natick, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/725,152

(22) Filed: Mar. 16, 2007

(65) Prior Publication Data

US 2007/0295237 A1 Dec. 27, 2007

Related U.S. Application Data

(60) Continuation of application No. 10/958,721, filed on Oct. 5, 2004, now Pat. No. 7,194,959, which is a continuation of application No. 10/313,879, filed on Dec. 6, 2002, now Pat. No. 6,857,369, which is a division of application No. 09/281,203, filed on Mar. 30, 1999, now Pat. No. 6,490,977.

(60) Provisional application No. 60/095,805, filed on Aug. 7, 1998, provisional application No. 60/079,853, filed on Mar. 30, 1998.

(51) Int. Cl.
*F42B 4/06* (2006.01)
*F42B 3/18* (2006.01)

(52) U.S. Cl. ..... 102/342; 102/351; 102/357; 102/206; 102/202.1; 102/202.2; 102/202.4; 102/215

(58) Field of Classification Search ..... 102/206, 102/215, 217, 218, 200, 202.1, 202.2, 202.4, 102/342, 351, 357, 361
See application file for complete search history.

(56) References Cited

U.S. PATENT DOCUMENTS

| | | | |
|---|---|---|---|
| 3,570,404 | A | 3/1971 | Pope |
| 4,015,531 | A | 4/1977 | Ziemba |
| 4,068,592 | A | 1/1978 | Beuchat |
| 4,144,814 | A | 3/1979 | Day et al. |
| 4,239,005 | A | 12/1980 | Simmons |
| 4,267,567 | A | 5/1981 | Nygaard et al. |
| 4,335,653 | A | 6/1982 | Bratt et al. |
| 4,354,432 | A | 10/1982 | Cannavo et al. |

(Continued)

FOREIGN PATENT DOCUMENTS

| | | |
|---|---|---|
| AU | 65853/90 | 5/1991 |

(Continued)

OTHER PUBLICATIONS

Raphael Troussalle et al., Electronic Delay Detonator, Sep. 16, 1996.

*Primary Examiner*—James S Bergin
(74) *Attorney, Agent, or Firm*—Pandiscio & Pandiscio, P.C.

(57) ABSTRACT

A system and method are disclosed for controlling the launch and burst of pyrotechnic projectiles in a pyrotechnic, or "fireworks", display.

6 Claims, 11 Drawing Sheets

U.S. PATENT DOCUMENTS 4,363,272 A 12/1982 Simmons
4,409,898 A 10/1983 Blix et al.
4,419,933 A 12/1983 Kirby et al.
4,537,131 A 8/1985 Saunders
4,586,437 A 5/1986 Miki et al.
4,632,031 A 12/1986 Jarrott et al.
4,633,779 A 1/1987 Biggs et al.
4,641,580 A 2/1987 Ogatsu
4,674,047 A 6/1987 Tyler et al.
4,703,693 A 11/1987 Spies et al.
4,712,477 A 12/1987 Aikon et al.
4,825,765 A 5/1989 Ochi et al.
4,829,899 A 5/1989 Wiker et al.
4,848,232 A 7/1989 Kurokawa et al.
4,884,506 A 12/1989 Guerreri
4,962,706 A 10/1990 Ivermee et al.
5,014,622 A 5/1991 Jullian
5,069,129 A 12/1991 Kunitomo
5,123,355 A 6/1992 Hans et al.
5,214,236 A 5/1993 Murphy et al.
5,229,541 A 7/1993 Will et al.
5,295,438 A 3/1994 Hill et al.
5,308,149 A 5/1994 Watson et al.
5,335,598 A 8/1994 Lewis et al.
5,339,741 A 8/1994 Craven et al.
5,363,765 A 11/1994 Aikou et al.
5,440,990 A 8/1995 Wiedefeld et al.
5,499,579 A 3/1996 Lewis
5,520,114 A 5/1996 Guimard et al.
5,526,750 A 6/1996 Poor et al.
5,544,585 A 8/1996 Duguet
5,559,303 A 9/1996 La Mura et al.
5,563,366 A 10/1996 La Mura et al.
5,571,985 A 11/1996 Ritter et al.
5,621,184 A 4/1997 Gwynn, III
5,623,117 A 4/1997 Lewis
5,627,338 A 5/1997 Poor et al.
5,691,500 A 11/1997 Mancini
5,739,462 A 4/1998 Poor et al.
5,894,103 A 4/1999 Shann
5,912,428 A 6/1999 Patti
6,082,265 A 7/2000 Sakamoto et al.
6,173,651 B1 1/2001 Pathe et al.

FOREIGN PATENT DOCUMENTS

GB 2121089 12/1983
WO WO 92/08932 A1 5/1992

(1 OF 4)

(2 OF 4)

(3 OF 4)

(4 OF 4)

PRECISION PYROTECHNIC DISPLAY SYSTEM AND METHOD HAVING INCREASED SAFETY AND TIMING ACCURACY

REFERENCE TO PENDING PRIOR PATENT APPLICATIONS

This patent application is a continuation of prior U.S. patent application Ser. No. 10/958,721, filed Oct. 5, 2004 now U.S. Pat. No. 7,194,959 by George Bossarte et al. for PRECISION PYROTECHNIC DISPLAY SYSTEM AND METHOD HAVING INCREASED SAFETY AND TIMING ACCURACY, which in turn is a continuation of prior U.S. patent application Ser. No. 10/313,879, filed Dec. 6, 2002 now U.S. Pat. No. 6,857,369 by George Bossarte et al. for PRECISION PYROTECHNIC DISPLAY SYSTEM AND METHOD HAVING INCREASED SAFETY AND TIMING ACCURACY, which is a division of prior U.S. patent application Ser. No. 09/281,203, filed Mar. 30, 1999 now U.S. Pat. No. 6,490,977 by George Bossarte et al. for PRECISION PYROTECHNIC DISPLAY SYSTEM AND METHOD HAVING INCREASED SAFETY AND TIMING ACCURACY, which in turn claims benefit of (i) U.S. Provisional patent application Ser. No. 60/095,805, filed Aug. 7, 1998 by Paul R. McKinley et al. for PRECISION PYROTECHNIC DISPLAY SYSTEM HAVING INCREASED SAFETY AND TIMING ACCURACY; and (ii) U.S. Provisional patent application Ser. No. 60/079,853, filed Mar. 30, 1998 by Paul McKinley, for ELECTRONIC PYROTECHNIC IGNITOR OFFERING PRECISE TIMING AND INCREASED SAFETY.

The above-identified patent applications are hereby incorporated herein by reference.

FIELD OF THE INVENTION

This invention relates to the control of the launch and burst of pyrotechnic projectiles in a pyrotechnic display. More particularly, the invention relates to the use of electronic components for the purpose of improving the accuracy of the timing of both the launch and the burst of the pyrotechnic projectiles. The invention further relates to the use of electronic components for the purpose of increasing the safety of both the pyrotechnic operator and the viewing audience.

BACKGROUND OF THE INVENTION

The professional fireworks industry has employed black powder-based pyrotechnic ignition systems for many years. These systems typically use a black powder fuse—cotton string or cord impregnated with black powder—to ignite a "lift" charge, which propels the projectile high into the air. The ignition of the lift charge also ignites a second black powder fuse, which provides a time delay to allow the projectile to reach a desired height above the ground. After the time delay of the fuse, the "break" charge is ignited, causing the particular visual or auditory effect of the pyrotechnic projectile.

Although black powder-based ignition systems are relatively easy to use, the fundamental limitations of the black powder fuse prevent the industry from achieving the timing accuracy and repeatability necessary for precisely choreographed pyrotechnic displays. This is because the burn rate—and hence the delay time—for a black powder fuse can vary considerably depending on the fabrication of the fuse, the particular materials used in the construction of the fuse, and on other parameters such as the temperature of the fuse at the time of ignition. U.S. Pat. No. 5,627,338 by Poor et al. teaches that the typical accuracy of the time delay of a black powder fuse is on the order of +/−16%. Controlling the delay time for a black powder fuse to better than +/−1% is extremely difficult; and even if this accuracy could be reliably achieved, it would still contribute to a total variability of 100 milliseconds for a 5-second fuse. That is, a +/−1% variation would cause a 5-second fuse to vary by +/−0.05 seconds, or a total variability of 100 milliseconds. Tests with pyrotechnic audiences have shown that most people can detect timing differences as small as 20 milliseconds, and half the people can detect timing differences as small as 10 milliseconds. Thus, in order to achieve precisely choreographed displays for certain types of pyrotechnic shells, particularly shells with a short burst time, the variability of the fuse's time delay must be held to better than 10 milliseconds, and preferably to about 1 millisecond. A variability of 1 millisecond represents an additional factor of 100, or +/−0.01% accuracy for a 5-second fuse. Achieving such accuracy is impossible with black powder fuses.

In addition, the inherent limitations of the black powder fuse also provide a source of potential failures that present real risk to both the display operators and the proximate audience. Pyrotechnic shells can be manufactured with the lift and break charges protected relatively well from external sources of accidental ignition by the use of protective layers around the charges. However, the use of a black powder fuse for the lift charge necessitates the exposure of the black powder to the external environment of the shell. Consequently the shell becomes much more sensitive to false ignition by burning materials from nearby pyrotechnic shells, resulting in unintentional "crossfire". If the lift charge of a shell is ignited but the time delay fuse to the break charge burns too slowly, a "hangfire" occurs, in which the shell explodes as it returns to the ground, often near the display operator or in the audience. Even more dangerous, if a hangfire explodes after the shell hits the ground, both the explosion and the falling shell itself present significant risks to the operator and audience. If a fuse fails to ignite the lift charge, but the fuse continues to burn and ignites the break charge while the shell is still on the ground, a "mortar burst" can occur, and the ignition products of the break can potentially ignite the break charges of all the adjacent shells of the display. A break charge being ignited on the ground can result in serious injury to the operating personnel as well as the destruction of the entire display.

A number of alternatives have been proposed to eliminate black powder fuses or to improve their reliability. The most notable of these involves the use of electrically operated ignition devices, commonly called "electric matches" or "e-matches". The construction and ignition of various forms of e-matches are described in U.S. Pat. Nos. 5,544,585 by Duguet, 5,123,355 by Hans et al., 4,409,898 by Blix et al., 4,354,432 by Cannavo' et al., 4,335,653 by Bratt et al., 4,267,567 by Nygaard et al., and 4,144,814 by Haas et al.

The use of an e-match to replace the black powder fuse for igniting a lift charge has the advantage that the exposed electrical wires are not susceptible to false ignition by sparks or other ignition by-products. Such use of the e-match reduces the likelihood of crossfires, but does nothing to improve the timing of the break since a black powder delay fuse would still be required to ignite the break charge. On the other hand, U.S. Pat. Nos. 5,627,338 by Poor et al., 5,623,117 by Lewis, 5,499,579 by Lewis, 5,335,598 by Lewis et al., 4,363,272 by Simmons, 4,239,005 by Simmons, and 4,068,592 by Beuchat describe methods to delay the firing action of an e-match based on electrical or pyrotechnic delays, but none of these methods are suitable to achieving the high accuracy required for choreographed displays. A method of using an e-match is described by Poor et al. in U.S. Pat. No. 5,627,338, but even this technique is limited to about 25 milliseconds variability, which is still a factor of 25 worse than the desired 1 millisecond variability previously discussed.

A number of problems or faults can occur during the setup of a choreographed pyrotechnic display. The pyrotechnic operator cannot easily detect many of these problems. If e-matches are used to replace the black powder fuses, new problems unique to e-matches are possible. For example, if e-matches are used to ignite the black powder lift charges, the electrical connections to the e-matches may be faulty. A common practice by the industry is to connect multiple e-matches to the same ignition source to allow multiple shells to be fired at the same time. Such multiple connections are done either in parallel or in series. If multiple e-matches are wired in parallel to a single electrical ignition source, the possibility exists that some e-matches will not be connected properly. On the other hand, if multiple e-matches are wired in series, the possibility exists that the electrical ignition source will be insufficient to ignite all of the e-matches.

If e-matches are used to ignite both the lift and break charges, additional problems may develop. For example, either or both of the e-matches may have broken wires. Furthermore, since an energy source is required to fire both e-matches (and the source for the break match must travel with the projectile), the possibility exists that either energy source may be insufficient to ignite its corresponding e-match. If, for example, the lift energy source is sufficient to ignite the lift charge, but the break energy source is not sufficient to ignite the break charge, a dangerous hangfire can result, with significant risk to the pyrotechnic operator and the audience.

Accordingly, a definite need exists for a method and system for launching and detonating pyrotechnic displays, which is capable of accuracy on the order of 1 millisecond, particularly for conventional shells that use black powder for the lift charge. A need also exists for increasing the safety for both the pyrotechnic operator and the viewing audience for conventional black powder shells. A need also exists for increasing the safety for pyrotechnic shells that use e-matches to ignite the charges. The present invention satisfies these requirements and additionally provides further related advantages.

OBJECTS AND SUMMARY OF THE INVENTION

In a broad sense, the present invention describes a method and system for controlling the launch and burst of pyrotechnic projectiles in a pyrotechnic display. More particularly, the present invention describes a method and system for increasing the safety and improving the accuracy of ignition timing for pyrotechnic displays.

An object of the present invention is to provide a system capable of achieving ignition timing accuracy to better than 1 millisecond for pyrotechnic displays. A further object of the present invention is to achieve such accuracy in ignition timing for pyrotechnic displays that use conventional black powder for the lift charge. An additional object of the present invention is to achieve such accuracy in ignition timing for pyrotechnic displays that use means other than black powder, such as pneumatic power, for launching the pyrotechnic projectile.

A further object of the present invention is to provide the capability to use standard pyrotechnic projectiles with black powder fuses for some, but not all, of the pyrotechnic display. Thus pyrotechnic operators can mix pyrotechnic shells utilizing the present invention with more conventional pyrotechnic shells in order to achieve the most cost-effective pyrotechnic display possible.

A further object of the present invention is to increase the safety of the pyrotechnic display for both the pyrotechnic operator and the viewing audience. A further object of the present invention is to reduce the potential of misfires and crossfires (i.e., the ignition of a projectile by the ignition products of nearby shells) by eliminating the traditional black powder fuse. A further object of the present invention is to reduce the potential of hangfires (i.e., shells that explode after returning to the ground).

A further object of the present invention is to provide the capability of reporting to the pyrotechnic operator the existence of faults within the system and to indicate which shells will not have their lift charge ignited because of the presence of these faults.

A further object of the present invention is to provide the capability to use multiple shells on the same ignition output and to provide the capability of reporting to the pyrotechnic operator the existence of faults in any of the individual shells.

While the present invention is presently intended primarily for use in improved pyrotechnic displays, the invention's advantages of increased safety and timing accuracy may be applied to other fields as well, such as construction and explosive demolition.

DETAILED DESCRIPTION OF THE PREFERRED EMBODIMENTS

The present invention involves a system and method for controlling the launch and burst of pyrotechnic projectiles in a pyrotechnic, or "fireworks," display.

Pyrotechnic Projectile

Figure 1:
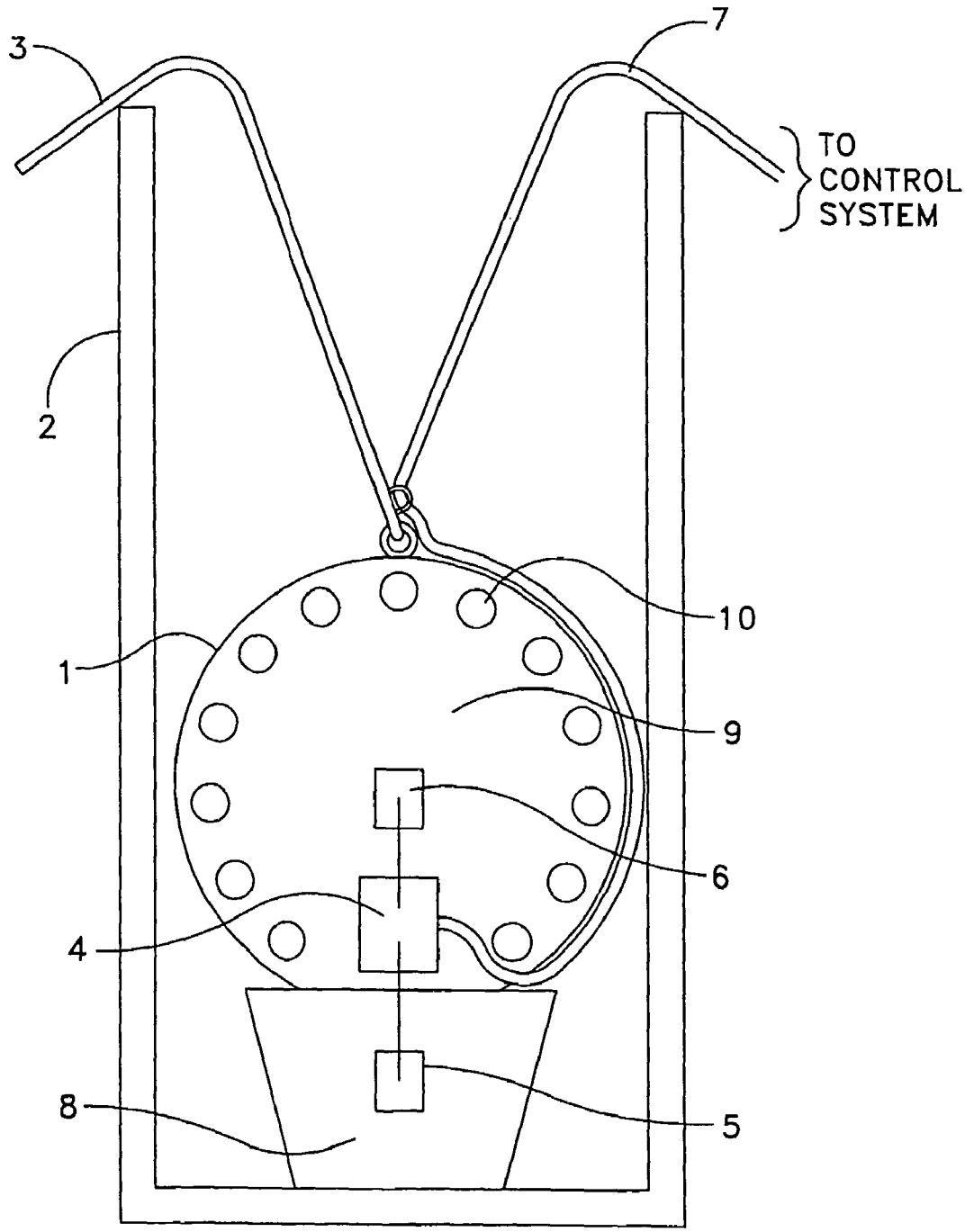
FIG. 1 shows a mortar with a pyrotechnic shell that contains an ignitor module of the present invention.

FIG. 1 shows a typical pyrotechnic projectile 1 placed in mortar 2. Projectile 1 utilizes load cord 3 to allow the pyrotechnic operator to easily place the projectile into mortar 2.

Embedded inside projectile 1 is ignitor 4 which is connected to the lift electric match (e-match) 5 and to the break e-match 6. Wires 7 connect ignitor 4 to the pyrotechnic control system. Lift e-match 5 is embedded in lift charge 8, which is typically made of black powder. Lift charge 8, when ignited, provides the force to propel projectile 1 high into the air. Break e-match 6 is embedded in break charge 9, which is also typically made of black powder. Break charge 9, when ignited by break e-match 6, causes projectile 1 to burst and provide the visual or auditory effect desired. Projectile 1 may contain additional pyrotechnic materials, such as stars 10, which enhance the visual or auditory effect of the projectile.

Control System

Figure 2:
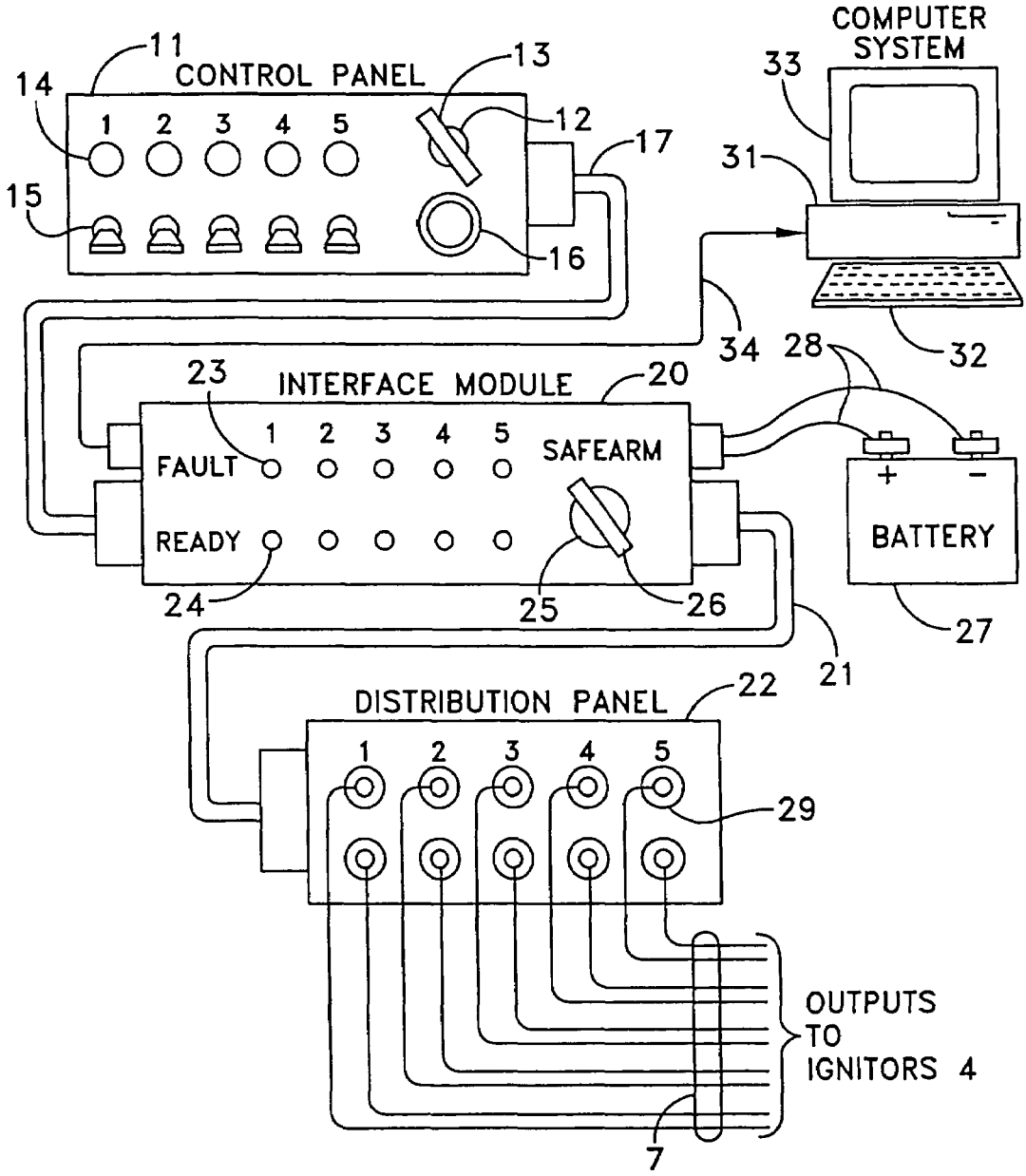
FIG. 2 shows a block diagram of a complete pyrotechnic display system illustrating one embodiment of the present invention.

FIG. 2 shows a block diagram of the control system. Control panel 11 is a manual control board which would be used by the pyrotechnic operator. Control panel 11 includes a key switch 12 for enabling the firing of the pyrotechnic shells. Use of key 13 allows the operator to remove the key to prevent accidental firing of the shells. The front panel of control panel 11 includes indicators 14, typically incandescent lamps or light emitting diodes ("LED's"), which provide information on the status of the individual channels, or "cues." The term "cue" has come into popular usage because of the interest in synchronizing the burst of the pyrotechnic projectiles with music. Although FIG. 2 shows five cues on the front panel, in practice the control panel 11 will typically have many more cues, possibly as many as 20 to 40. Control panel 11 also includes switches 15 that allow individual cues to be enabled for ignition at a particular time. The pyrotechnic operator will select one or more cues for ignition, observe the status of the cues, and then press firing button 16, which initiates the ignition of the launch of the pyrotechnic shells for the enabled cue(s). After the firing of the previously-selected cue(s), the operator will select the next cue and again press the Firing Button 16 in order to initiate the launch of the shell or shells for that cue. By sequencing through the cues, the operator is able to use control panel 11 and firing button 16 to control the entire pyrotechnic display.

In FIG. 2, cable 17 connects control panel 11 to interface module 20. Interface module 20 contains electronics that receive firing signals from control panel 11 and generates the necessary control voltages to fire the ignitors 4 in the pyrotechnic shells (FIG. 1). These control voltages are passed through cable 21 to a distribution panel 22. Interface module 20 includes additional display indicators 23 and 24 which provide information to the pyrotechnic operator of the status of each of the cues. Since interface module 20 is located closer to the pyrotechnic shells than control panel 11, the display indicators 23 and 24 are used primarily during set up of the pyrotechnic display in order to verify that the system is wired properly. Interface module 20 also includes key switch 25 and key 26 to ensure that no power is applied to any ignitor 4 while people are loading the shells into the mortars. Interface module 20 is powered by battery 27 through cable 28.

Distribution panel 22 includes connectors 29, which allow the operator to hook up wires 7 (FIGS. 1 and 2) to connect the ignitors 4 to the control system.

Control panel 11 is assumed to be built in accordance with pyrotechnic industry standards for manual control boards. Specifically, any current applied to cable 17 for the purpose of measuring electrical continuity in a lift e-match 5 would be less than 50 milliamperes. Any current applied to cable 17 for the purpose of igniting lift e-match 5 would be greater than 250 milliamperes.

FIG. 2 also shows an optional computer system 31 that would be used in a second preferred embodiment. Computer system 31 includes keyboard 32 and monitor 33, which is connected to interface module 20 by cable 34. Computer system 31 would be used for automatically sequencing the firing of the projectiles in response to a computer program in coordination with other effects such as music. Manual control panel 11 would not be used if computer system 31 were controlling the pyrotechnic display.

In a third preferred embodiment (not shown), interface module 20 and distribution panel 22 are combined into a single package. This embodiment eliminates the need for cable 21 and provides a more compact assembly.

Ignitor

Figure 3:
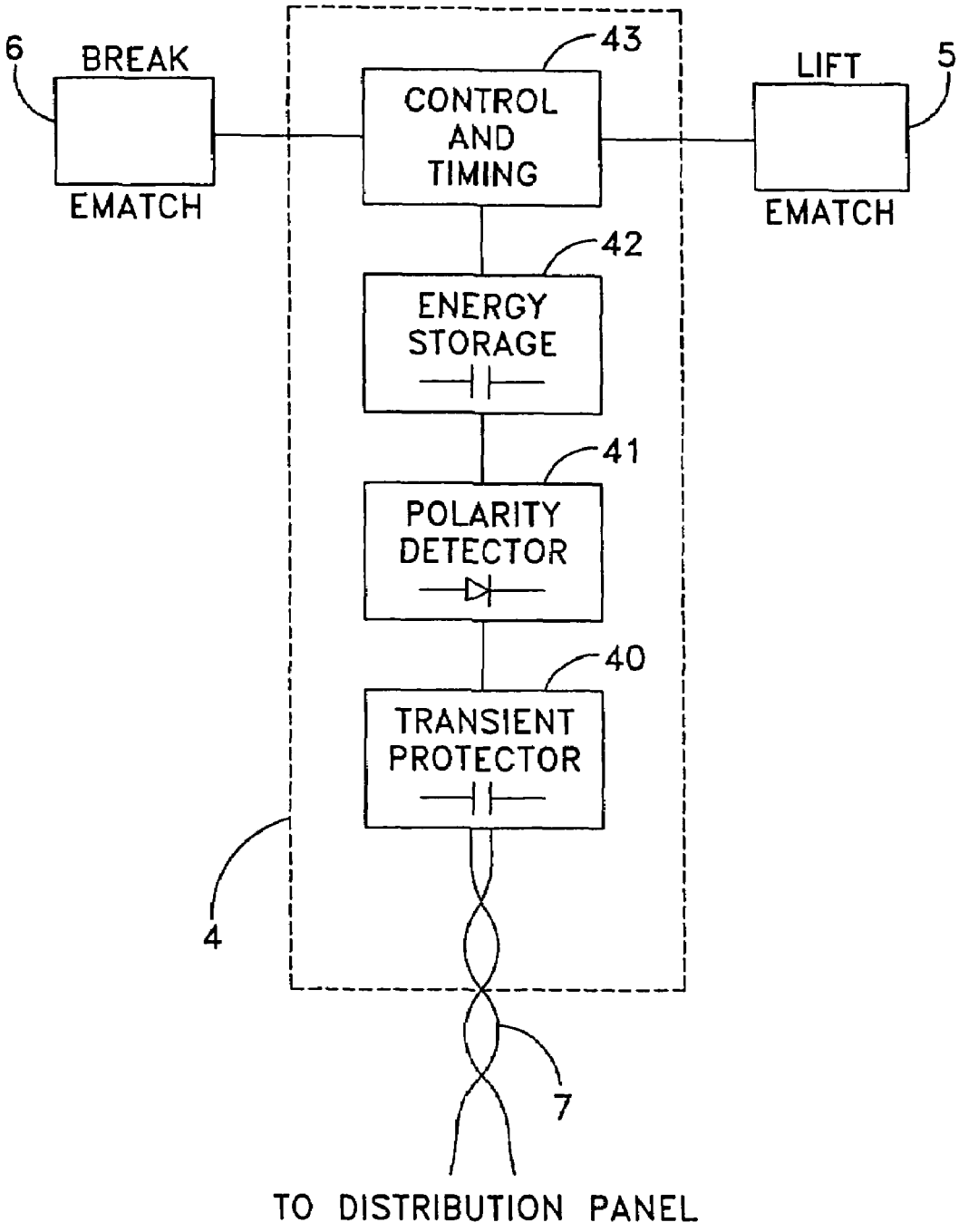
FIG. 3 shows the block diagram of an ignitor module of a preferred embodiment of the present invention.

FIG. 3 shows a block diagram of ignitor 4, which would be used for all three embodiments discussed above (i.e., a system utilizing manual control panel 11; a system utilizing computer system 31 in place of manual control panel 11; and a system combining interface module 20 and distribution panel 22 into a single package). FIG. 3 also shows lift e-match 5 and break e-match 6. Wires 7 connect ignitor 4 to the remainder of the pyrotechnic control system. Ignitor 4 contains four functional blocks, i.e., transient protector 40, polarity detector 41, energy storage element 42, and control and timing circuitry 43.

The purpose of transient protector 40 is to prevent electrostatic discharges or other transient high-voltage events from passing on to the remainder of ignitor 4 and possibly damaging ignitor 4 or accidentally firing either lift e-match 5 or break e-match 6.

Polarity detector 41 ensures that voltages are of the proper polarity and currents flow to the ignitor circuitry regardless of the polarity of wires 7. Referring back to FIG. 2, polarity detector 41 allows the operator to connect a pair of wires 7 to the corresponding pair of connectors 29 without regard to polarity. The use of polarity detector 41 thus simplifies the wiring task for the pyrotechnic operator and, more importantly, reduces the possibility of wiring errors.

The third functional block for ignitor 4 is energy storage element 42, which preferably comprises a capacitor. Recalling that ignitor 4 is embedded in pyrotechnic projectile 1, when the projectile is launched by the ignition of lift charge 8, wires 7 will be broken. Thus, ignitor 4 will be electrically separated from the distribution panel 22 and any source of energy, such as battery 27. Therefore, in order to ignite the break e-match 6, a source of energy must travel with projectile 1. Although energy storage element 42 could be a battery, the use of a capacitor is preferred for several reasons. First, a capacitor can weigh less than a battery. Second, a battery tends to be more expensive than a capacitor. Third, the capacitor is preferred for environmental reasons. Fourth, and most important, the use of a capacitor ensures that there is no source of ignition energy for either of the e-matches 5, 6 unless the pyrotechnic operator has intentionally provided the energy from battery 27 by use of key switch 25. The use of a capacitor for energy storage element 42 thus reduces the possibility of accidental ignition of the projectile 1 and increases the safety of the total system.

The fourth and final functional block for ignitor 4 is the control and timing circuitry 43, which is a microprocessor-based electronic circuit that is responsible for the ignition of the lift e-match 5 and break e-match 6. The control and timing circuitry 43 includes embedded software, or "firmware", which receives information from interface module 20 concerning the desired time for ignition and returns information back to interface module 20 regarding the status of ignitor 4.

As is discussed in greater detail below, the firmware includes both safety and timing features. These features preferably include verification of the following: (1) both lift e-match 5 and break e-match 6 are connected properly; (2) no ignition takes place unless both lift e-match 5 and break e-match 6 are verified electrically; (3) no ignition takes place unless sufficient energy is stored in energy storage element 42 to ensure proper ignition; (4) after the lift e-match 5 is ignited, launch is verified by loss of input power from wires 7; (5) break e-match 6 is not ignited unless launch has been verified; (6) no ignition of break e-match 6 will occur after a maximum time delay (to prevent hangfires); and (7) the timing of ignition of break e-match 6 occurs within 1 millisecond after the programmed delay following ignition of lift e-match 5 (i.e., the shell bursts within 1 millisecond of its intended time).

It should be appreciated that, with respect to the timing delay between activation of lift e-match 5 and break e-match 6, this timing delay can either be (1) pre-programmed into the embedded software, or "firmware", of the ignitor's control and timing circuitry 43, or (2) programmed into ignitor 4 at the time of use by the control system, e.g., by computer system 31.

Interface Module

Figure 4:
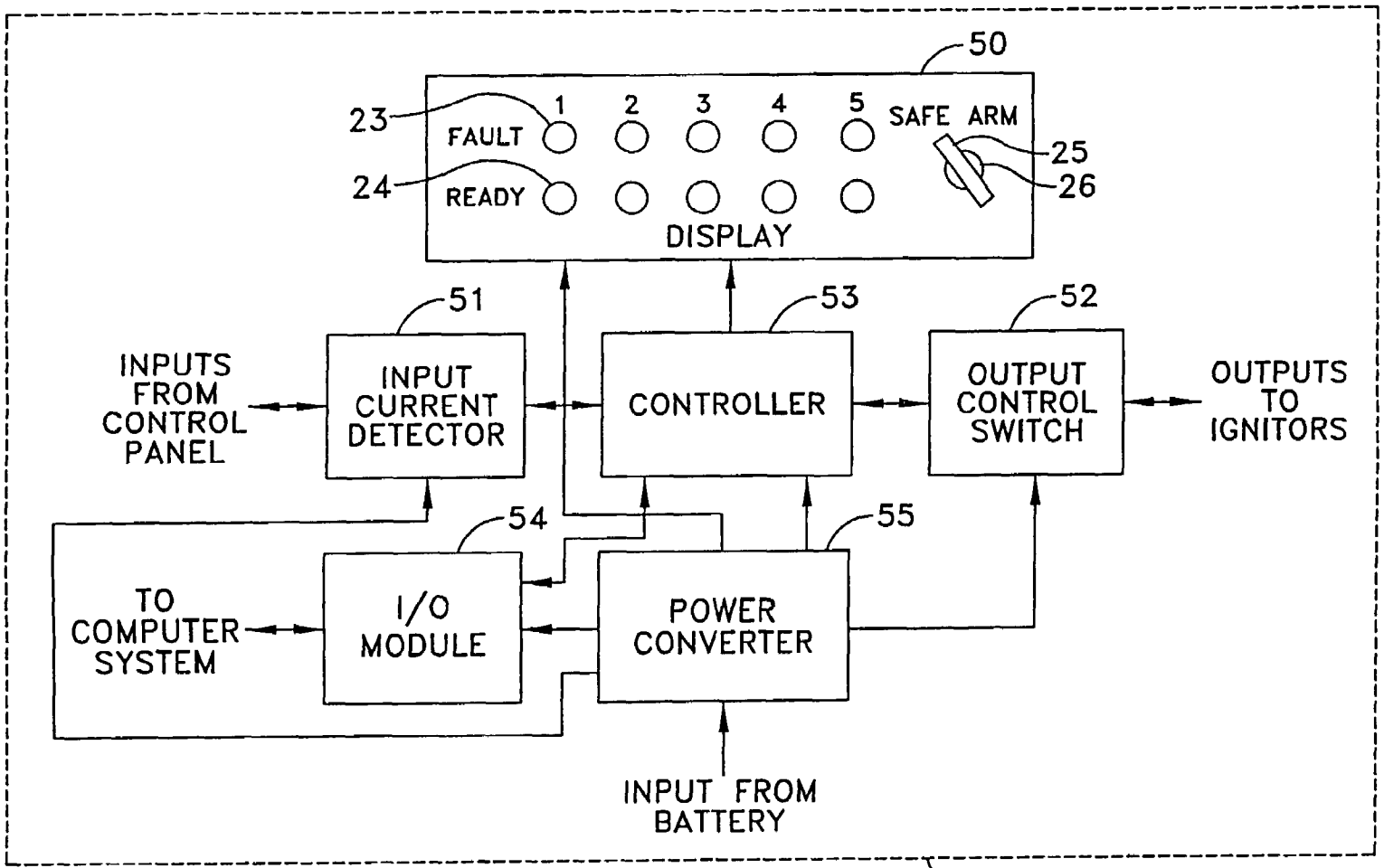
FIG. 4 shows the block diagram of one embodiment of the interface module of the present invention.

As shown in FIG. 4, the block diagram of interface module 20 includes six functional blocks.

Front panel 50 of interface module 20 includes fault indicators 23 and ready indicators 24 that show the status of each of the system cues. Fault indicators 23 and ready indicators 24 can be made from incandescent lamps, light emitting diodes (LED's), or other suitable visible devices. Front panel 50 also includes key switch 25 and key 26 which can be used by the pyrotechnic operator to enable or disable ignition of the pyrotechnic shells. By putting key switch 25 into the "Safe" position and removing key 26, the pyrotechnic operator can ensure that no ignition is possible while pyrotechnic projectiles 1 are being installed in mortars 2.

The second functional block of interface module 20 is input current detector 51, whose purpose is to detect if any electrical current is being drawn from cable 17 (FIG. 2) for any cue. Furthermore, input current detector 51 determines if the current is less than 50 milliamps (corresponding to a continuity test) or is greater than 250 milliamps (corresponding to a Fire command).

The third functional block for interface module 20 is output control switch 52, whose purpose is to communicate if any ignitors 4 are connected to the particular cue. Such communication is bi-directional in nature. Output control switch 52 is further responsible for providing continuity current (less than 50 milliamps) and firing current (greater than 250 milliamps) if standard lift e-matches 5 are directly connected to the cue.

The fourth functional block for interface module 20 is controller 53, a microprocessor-based circuit that supervises the entire operation of interface module 20. Controller 53 receives input information from input current detector 51 and generates output signals for output control switch 52. Controller 53 also receives status information from ignitors 4 and communicates that status information back to the control panel 11 through input current detector 51. Controller 53 further reads the state of key switch 25 and displays status information on front panel display 50. Additional details of the communication between interface module 20 and other parts of the pyrotechnic control system are discussed below.

If the pyrotechnic display is being controlled by computer system 31, rather than control panel 11, communications between controller 53 and computer system 31 are handled by I/O module 54.

The final functional block of interface module 20 is power converter 55, which draws power from battery 27 and provides regulated voltages for the remaining functional blocks of interface module 20.

System Logic Flow

Figure 5:
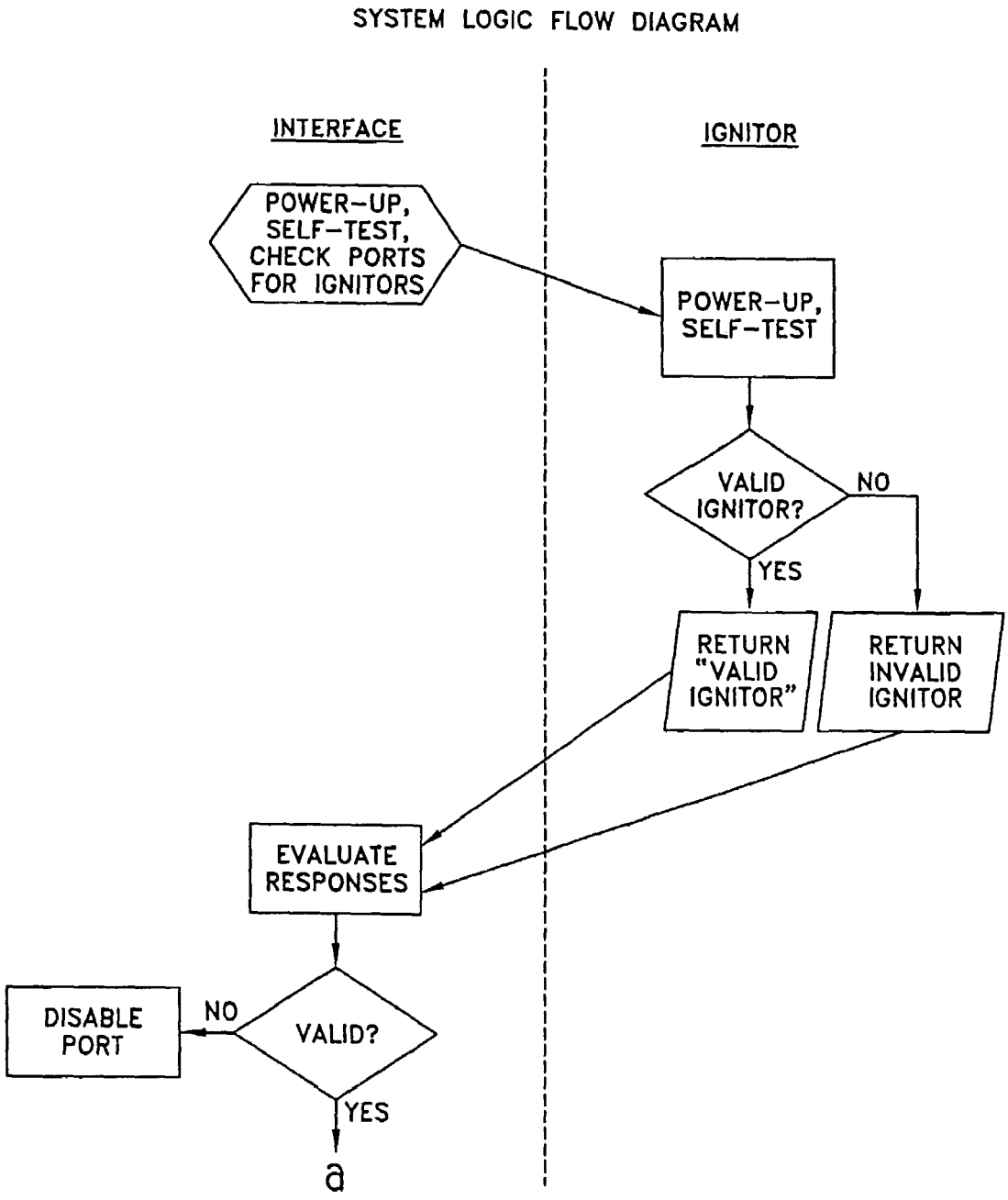
FIG. 5 shows a flow chart for the system logic including the communications between the interface module and the ignitor module in one embodiment of the present invention.
Figure 5:
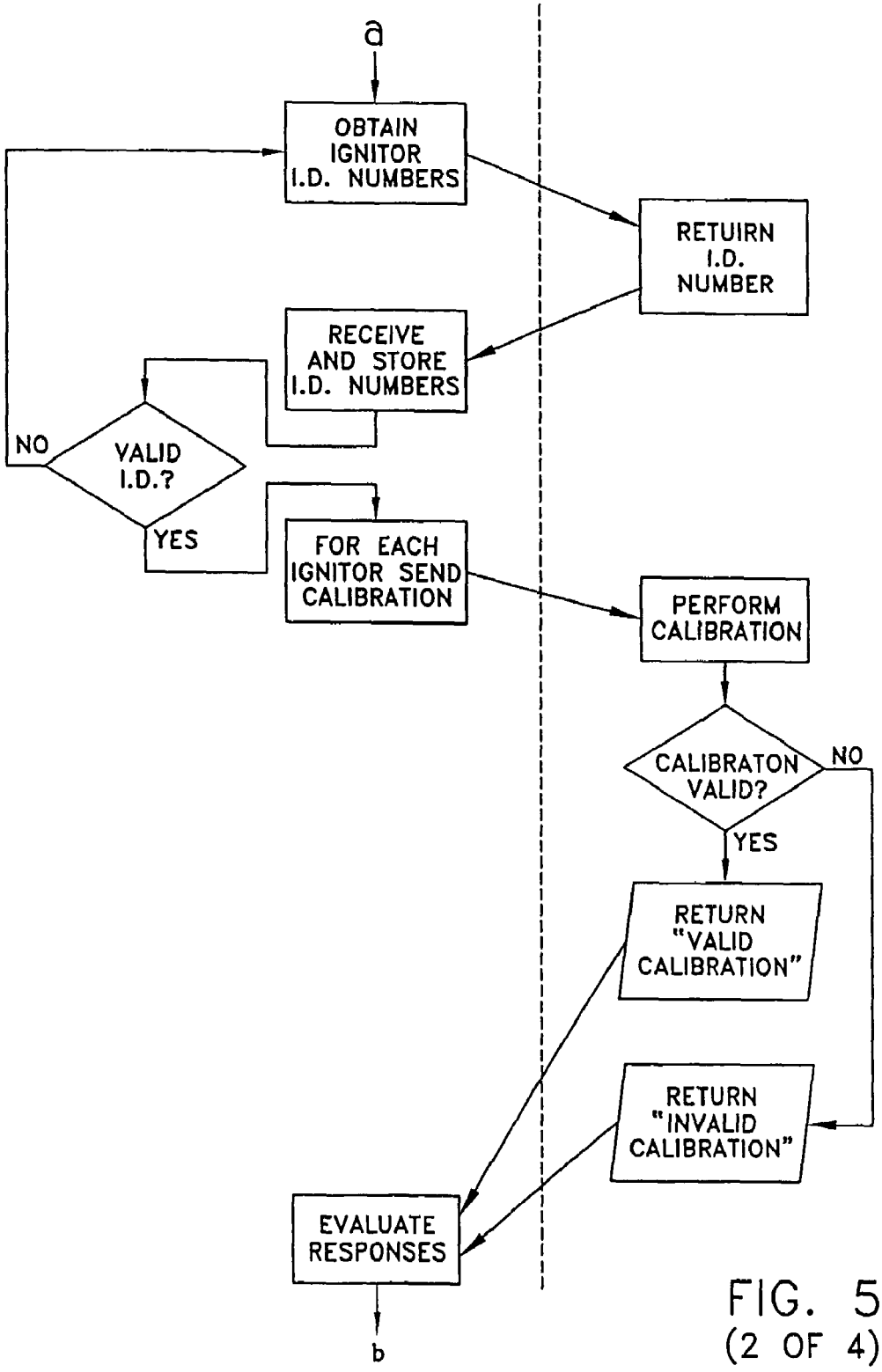
Figure 5:
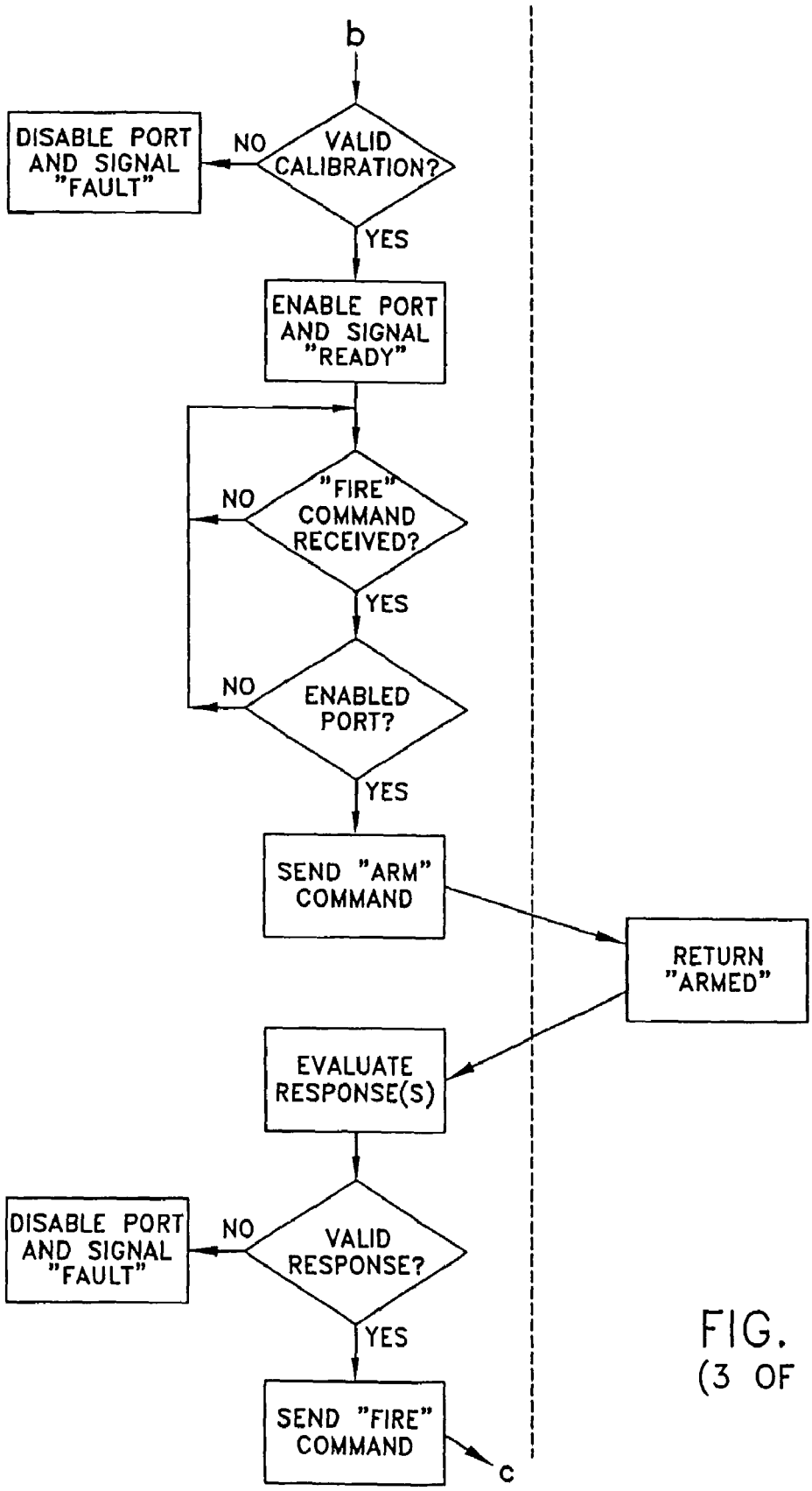
Figure 5:
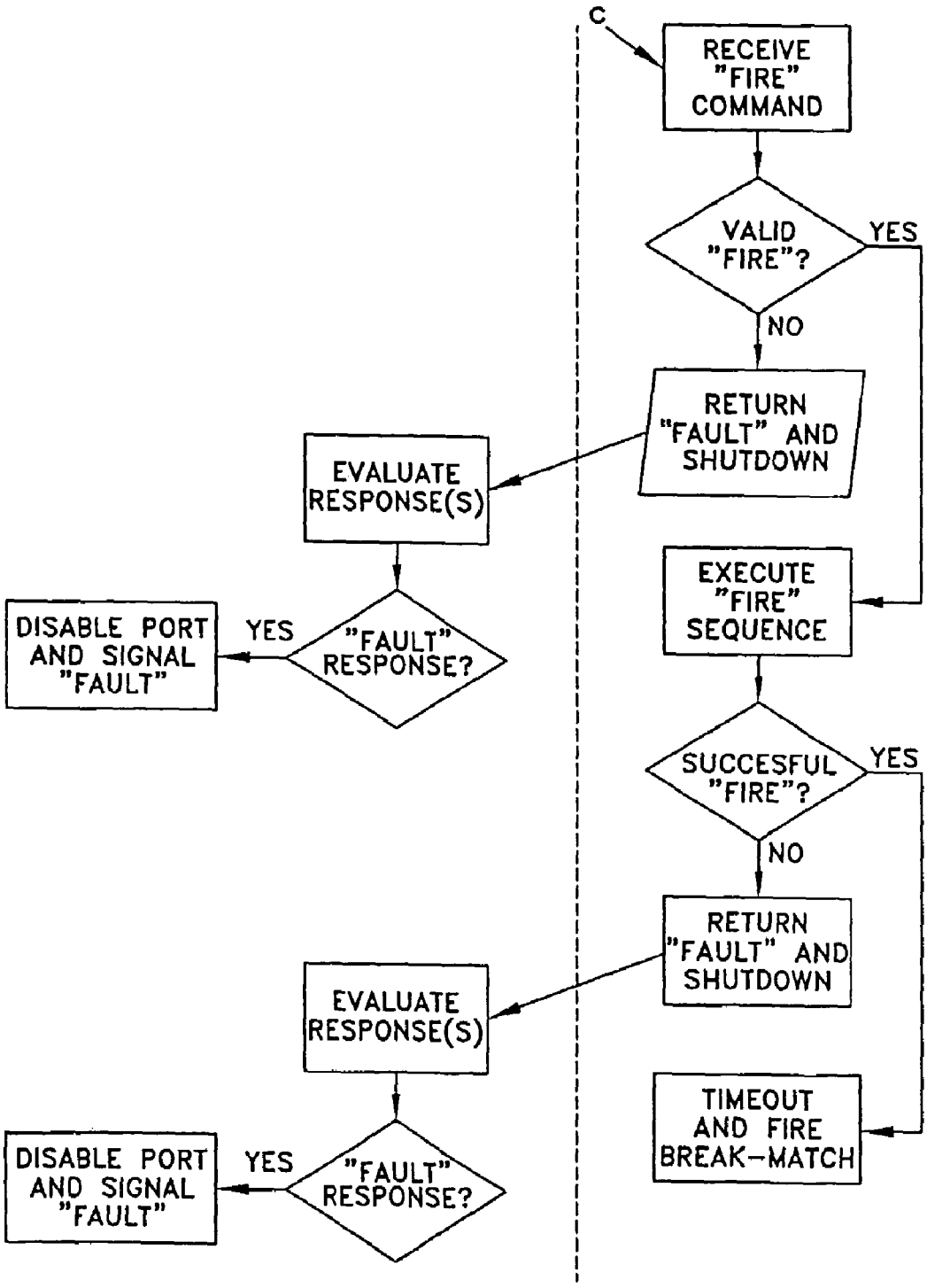

FIG. 5 shows the system logic flow diagram, including interaction between interface module 20 and ignitors 4. The use of microprocessors in both interface module 20 and in each ignitor 4 allows diagnostics to be performed in multiple locations and further provides for a high level of communication between different microprocessors. Furthermore, each microprocessor is capable of performing tests to verify that commands are consistent with operating conditions. For example, the microprocessor in each ignitor 4 is able to determine if all conditions necessary for a successful launch and burst of the pyrotechnic projectile are being satisfied and is further able to communicate that information back to interface module 20.

Upon power-up, interface module 20 executes a series of self-tests to confirm that all operating parameters, including input and output ports, are functioning properly. If so, interface module then examines its individual output ports to determine if any ignitors 4 are connected. If an ignitor(s) 4 is found, interface module 20 applies a current-limited voltage to ignitor(s) 4 and requests status information. Should interface module 20 not receive a "valid ignitor" response on any port for which it previously detected the presence of an ignitor 4, it will disable, and signal a "fault" condition for, that particular port. Should interface module 20 detect multiple ignitors 4 on a given port, it will instruct all ignitors 4 on that port to generate a random number within a certain range as an identification (ID) number. It will then poll the port, sequentially stepping through subsets of the designated range, to ascertain the individual ID of each ignitor 4. Should more than one ignitor 4 return an ID within any one range subset, interface module 20 will instruct all ignitors 4 that subset to re-generate a new random number within ID within the range of that subset. Interface module 20 will then re-evaluate the ignitors 4 utilizing a higher resolution. This process will repeat until each ignitor 4 is assigned a unique ID number. All further communications between interface module 20 and each ignitor 4 utilize this ID to ensure unique ignitor communications.

In one embodiment of the present invention, the operating frequency of ignitor 4 is controlled by a resistor and capacitor combination. Since resistors and capacitors are generally not of high accuracy, the resulting frequency will vary from one ignitor 4 to another. Since the time delay of ignitor 4 is generated by counting cycles of its operating frequency, the time delay will depend directly on the value of the resistor and capacitor. In order to improve the accuracy of the time delay, interface module 20 next sends a timing calibration sequence to each ignitor 4. This sequence includes an accurately controlled pulse, 400 milliseconds in the preferred embodiment, which is measured by each ignitor 4. The ignitor 4 counts cycles of its operating frequency during the controlled pulse and reports the number of counts back to interface module 20. This process allows interface module 20 to indirectly measure the operating frequency of each ignitor 4 and to verify that the frequency is within acceptable limits. If the operating frequency of any ignitor 4 is outside the acceptable limits, interface module 20 will disable the respective output port and signal a "fault" condition. Assuming that the calibration sequence produces measurements within the acceptable limits, ignitor 4 will then use the results of the measurement of the controlled pulse to compensate for the inaccuracy of the operating frequency and to modify the pre-programmed time delay to improve the overall accuracy of the system. Then, as long as the operating frequency of the ignitor 4 remains constant, the time delay will be accurate. Experiments have shown that time delays of up to 5 seconds, accurate to better than 1 millisecond, can be obtained even if the operating frequency of the ignitor 4 is only accurate to + or −20%.

In a second embodiment of the ignitor 4, the operating frequency is determined by a more accurate crystal rather than a resistor and capacitor. As a result, the calibration process is not necessary in order to produce accurate time delays. However, the calibration process can still be used in order to verify the proper operation of ignitor 4 and to verify that the oscillator frequency of ignitor 4 is consistent with the crystal.

Having completed the evaluation of all ignitors 4 connected to the output ports, the interface module 20 then enables all output ports not previously disabled, turns on the respective "Ready" lights 24 on front panel 50 and provides a closed circuit at input current detector 51 that can be detected from control panel 11 as "continuity". This provides the pyrotechnic operator with remote indication (at control panel 11) of the status of all ports of interface module 20.

Interface module 20 next enters a program loop whereby it continuously looks for the receipt of a valid "fire" command at input current detector 51. Upon receipt of a "fire" command, interface module 20 confirms that the respective output port has not been disabled through failure of any previous test and validation sequence.

If the output port has not been disabled, interface module 20 issues an "arm" command to all ignitors 4 attached to the respective port and waits for confirmation from all ignitors 4 attached to that port that they have received a proper "arm" command and have entered the armed state. If any failure occurs in an ignitor 4, interface module 20 will disable the respective port and indicate a "fault" on front panel 50.

For all armed ports, the interface module 20 next issues a "fire" command. Upon receipt of a "fire" command, each ignitor 4 evaluates the "fire" command to ensure that it meets all protocol requirements. If the "fire" command does not meet protocol requirements, the ignitor 4 will return a "fault" command and immediately disable itself. If the "fire" command does meet protocol requirements, the ignitor 4 will fire lift e-match 5 and immediately check to see if the data/power cable has been disconnected, an expected result of the shell having lifted and broken the cable. Should the ignitor 4 detect that it is still connected to the interface module 20, it will assume that the lift charge failed to ignite, return a "fault" command to interface module 20 and immediately disable itself. If the ignitor 4 does detect a successful disconnect, it will enter its timing sequence until it reaches the programmed delay, upon which it will fire its break e-match 6 match, thereby igniting the pyrotechnic break charge and causing the shell to appear in the sky.

After the break e-match 6 ignites the break charge, the entire ignitor 4 will be destroyed. However, in case the ignition did not occur, ignitor 4 will wait a short period of time and then apply high current loads to the ignitor's microprocessor output ports in order to discharge energy storage element 42. In this manner, the source of energy to ignite break e-match 6 will be eliminated and the possibility of a late ignition of the break charge, termed a "hangfire", will be greatly reduced.

As an additional safeguard, the interface module 20 monitors the current flow through all ports which have been issued a "fire" command. If it detects any ignitors 4 still connected, it will disable that port and signal a "fault" condition on front panel 50 in order to notify the pyrotechnic operator that a particular mortar still holds a live pyrotechnic projectile 1.

Detailed Circuit of One Form of Ignitor

Figure 6:
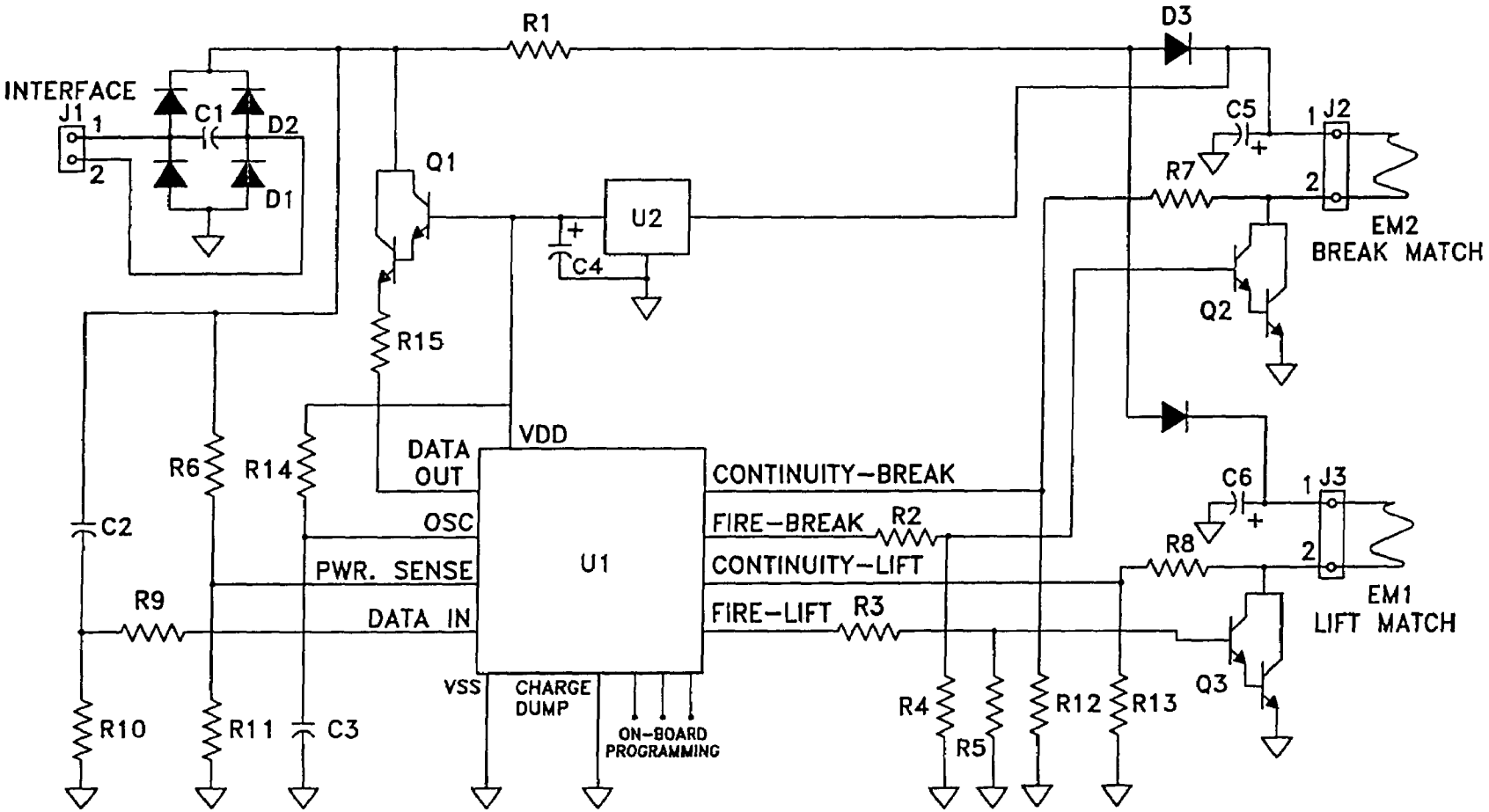
FIG. 6 shows the detailed schematic of the ignitor module for one embodiment of the present invention.

FIG. 6 shows the detailed circuit schematic for ignitor 4 for one embodiment of the present invention. Capacitor C1 provides protection from electrostatic discharges or any other voltage transients that may occur on the input wires at connector J1. Diode pairs D1 and D2 are configured as a full wave rectifier and ensure that the voltage that appears at the cathode of D2 is always positive. The use of diode pairs D1 and D2 allows the pyrotechnic operator to connect the two wires for ignitor 4 without regard to polarity. Resistor R1 limits the current into capacitors C5 and C6, which are isolated from each other by dual diode D3. When an input voltage of nominally 12 volts appears on the input wires at connector J1, the C5 and C6 capacitors begin to charge up. Capacitor C5 provides energy storage for the break e-match 6, which would be connected to ignitor 4 at connector J2. Thus capacitor C5 is energy storage element 42 previously discussed and shown in FIG. 3. Capacitor C6 provides energy storage for lift e-match 5, which is connected to ignitor 4 at J3. The use of capacitor C6 ensures that sufficient peak current will be available to ignite lift e-match 5 even though resistor R1 and any additional wire resistance in the input wires would otherwise limit the current available. Darlington transistor Q2 provides an electronic switch to connect break e-match 5 to capacitor C5. Resistor R2 connects output pin 8 of microprocessor U1 to the base of transistor Q2. Thus resistor R2 allows microprocessor U1 to ignite the break e-match 5 by applying a five-volt signal to output pin 8 and turning on transistor Q2. Resistor R4 ensures that transistor Q2 will not be accidentally turned on when the output pin 8 of microprocessor U1 is initially open-circuited during the power-on initialization of microprocessor U1. Transistor Q3 provides an electronic switch to connect lift e-match 5 to capacitor C6. Resistor R3 connects the base of transistor Q3 to output pin 7 of microprocessor U1. Thus microprocessor U1 can fire the lift e-match 5 by applying a five-volt signal to pin 7. Resistor R5 ensures that transistor Q3 will not be accidentally turned on when output pin 9 of microprocessor U1 is initially open-circuited during the power-on initialization of microprocessor U1. Resistors R7 and R12 provide a resistor divider to monitor the voltage on the collector of transistor Q2. If capacitor C5 is charged, the voltage at the collector of transistor Q2 will be approximately 10 volts if break e-match 6 is connected properly. If break e-match 6 is broken or if the wires to break e-match 6 are disconnected, the voltage at the collector of transistor Q2 will be approximately zero volts. Thus, the use of resistors R7 and R12 allows microprocessor U1 to determine if the break e-match 6 is operational by monitoring the voltage at input pin 9. In a similar manner, resistors R8 and R13 allow microprocessor U1 to determine the status of lift e-match 5 by monitoring the voltage on pin 6 of microprocessor U1.

Voltage regulator U2 provides a constant five-volt output at pin 3. Capacitor C4 provides a small amount of energy storage to ensure that when the break e-match 6 is ignited, the sudden load on capacitor C5 does not disturb the power source for microprocessor U1. Voltage regulator U2 is necessary because the operating frequency of the particular type of microprocessor, a PIC16C505, varies as the voltage at pin 1 of microprocessor U1 changes. Thus, voltage regulator U2 ensures that the operating frequency remains constant and that the accuracy of the time delay is maintained even if the voltage on capacitor C5 varies. Resistor R14 and capacitor C3 are the components that determine the operating frequency of microprocessor U1. As previously discussed, the accuracy of the time delay is improved by the timing calibration process.

The connection of pin 3 of microprocessor U1 to ground allows microprocessor U1 to rapidly discharge capacitor C5 by trying to drive pin 3 to 5 volts. The high current at the output port pin 3 will cause the supply current at pin 1 to increase. This in turn will cause a higher load current for the voltage regulator U2 and will discharge capacitor C5.

Resistors R1 and R6 form a resistor divider that allows microprocessor U1 to sense a successful launch of the pyrotechnic projectile 1. As long as power is applied to ignitor 4 through connector J1, the voltage at pin 11 of microprocessor U1 will be five volts. However, when the lift charge is ignited and the shell is launched, wires 7 will break. At this point, the voltage at pin 11 of microprocessor U1 will drop to zero volts, and can be detected by microprocessor U1.

Communication Between Ignitor and Interface Module

Figure 7:
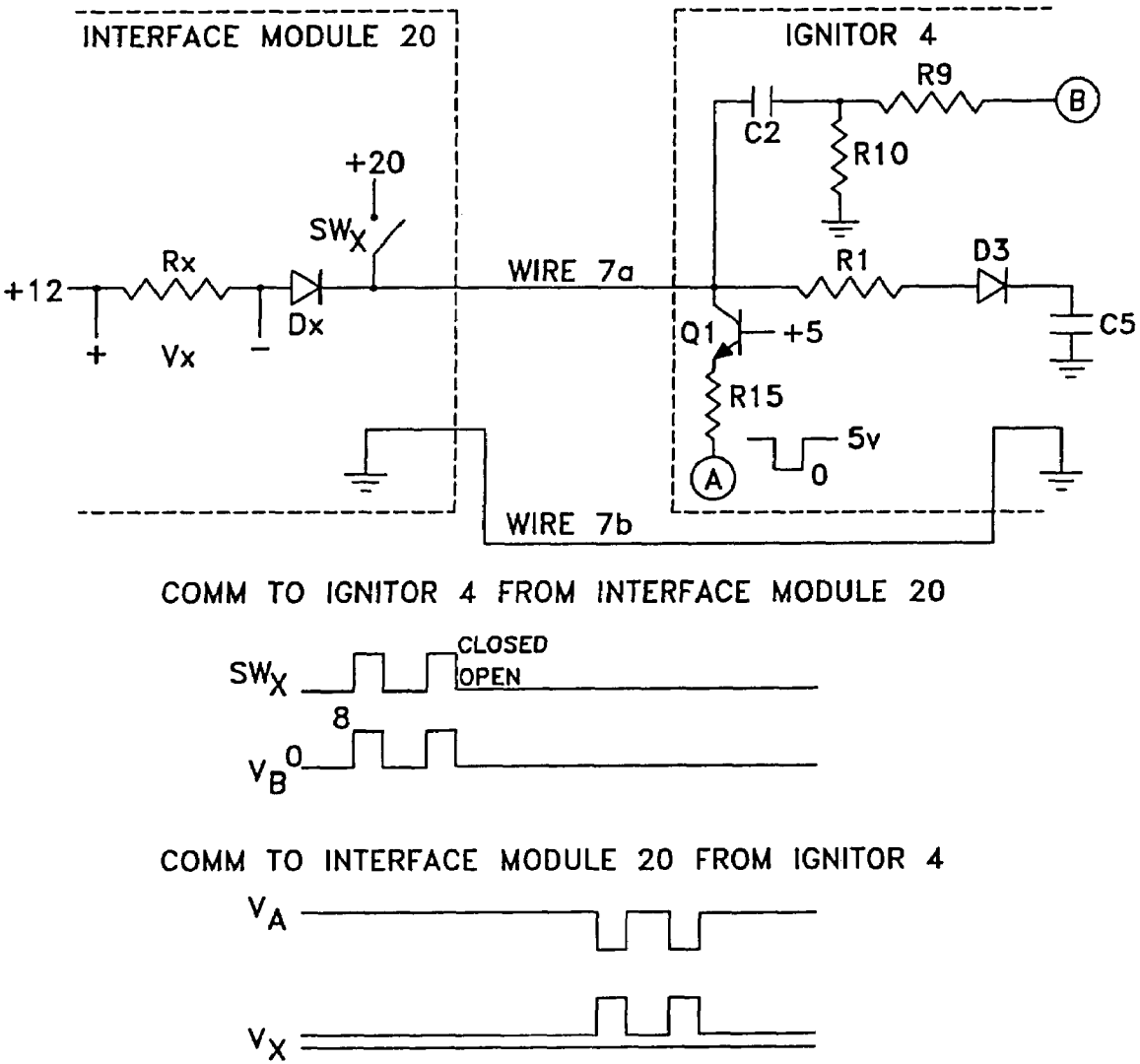
FIG. 7 shows details of bi-directional communications, over a single pair of wires, between the ignitor and the interface module.

Transistor Q1 and resistor R15 provide a means of communication from ignitor 4 to interface module 20. Capacitor C2 and resistors R9 and R10 provide a means of communication from interface module 20 to ignitor 4. The operation of this method of bi-directional communication over a single pair of wires, that also supply power, is best understood by looking at FIG. 7. Interface module 20 contains components Dx, Rx and Swx. Dx is a diode that provides the source of power (12 volts) for ignitor 4 through wire 7*a*. Wire 7*b* provides a ground return path to complete the power connection. Switch Swx, under control of the microprocessor in interface module 20, momentarily closes, causing the voltage at the cathode of diode Dx to become 20 volts. The quiescent value of the voltage at point B is nominally zero volts. When switch Swx closes, the 8-volt increase in the voltage on wire 7*a* is coupled by capacitor C2, through resistor R9, to point B. Thus, the voltage at point B will increase by 8 volts whenever switch Swx is closed, and will return to zero when switch Swx is opened. Resistor R9 ensures that any over-voltage at point B, which is connected to an input pin of microprocessor U1 of FIG. 6, does not adversely affect microprocessor U1. Resistor R9 further ensures that if the voltage at B becomes less than zero, microprocessor U1 is not adversely affected. Note that resistor R1, in conjunction with capacitor C5, reduces the switch current at switch Swx and further reduces any voltage change on capacitor C5 due to the low-pass filter nature of the circuit. Thus, pulses in the range of 1 microsecond to 100 milliseconds can be easily sent from interface module 20 to ignitor 4 with the particular component values chosen for the circuit. Communication in the reverse direction (from ignitor 4 to interface module 20) is accomplished with components transistor Q1, resistor R15 and resistor Rx. The voltage at point A is normally five volts and transistor Q1 is off. At that point, the current in wire 7*a* supplies the operating current for ignitor 4, which is a relatively small and constant value. As a result, Vx, the voltage across resistor Rx, is also a relatively small and constant value. When the voltage on point A is pulsed to zero volts, additional current flows through transistor Q1, causing the voltage across resistor Rx to increase. This increased current may be smaller than, or even much higher than, the nominal operating current for ignitor 4. By monitoring voltage Vx, the microprocessor in interface module 20 can receive information from ignitor 4 by using pulses at point A in the range of 1 microsecond to 100 milliseconds. Note that diode D3 prevents any current in transistor Q1 from being drawn from capacitor C5. Thus bi-directional pulsed communication can be accomplished with a pair of wires which are also supplying power. Not shown in FIG. 7 are the two diode pairs D1 and D2 in FIG. 6 which form the full wave rectifier and allow wires 7*a* and 7*b* to be connected in reverse to ignitor 4. Diodes D1 and D2 do not adversely affect the bi-directional communication method.

Detailed Circuit of Alternative Form of Ignitor

Figure 8:
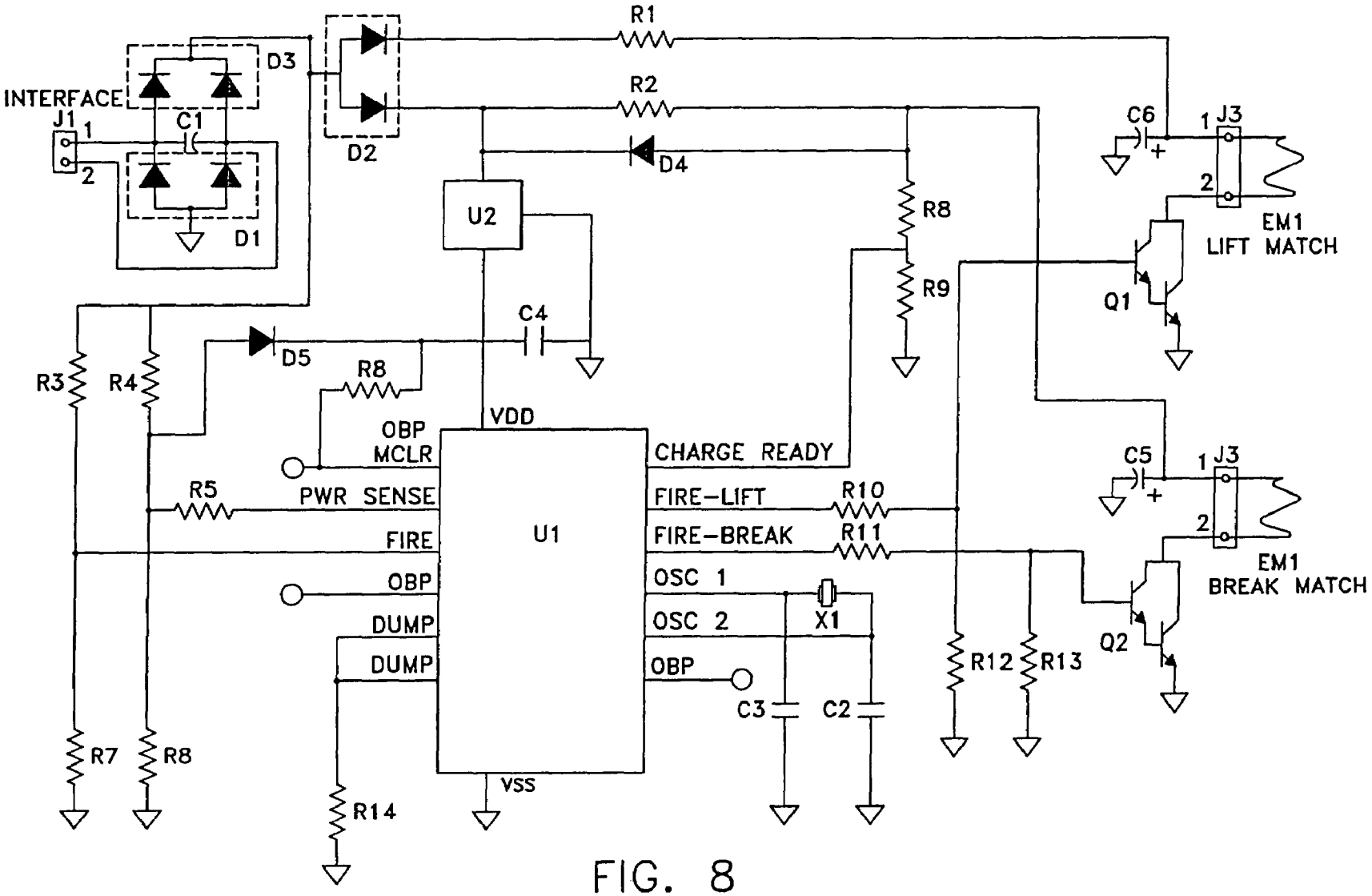
FIG. 8 shows the detailed schematic of the ignitor module for a second embodiment of the present invention.

FIG. 8 shows the detailed schematic of ignitor 4 in a second embodiment of the present invention. This version of ignitor 4 is quite similar to the embodiment of FIG. 6 in a number of ways. The similarities include the input protection, full wave rectifier, energy storage, voltage regulation, and lift e-match 5 and break e-match 6 drivers.

The schematic of FIG. 8 differs from that of FIG. 6 in the following ways. First, there is no provision for bi-directional communication between ignitor 4 and interface module 20. Second, ignitor 4 uses a different firing protocol from interface module 20. This protocol, used by the Fire One Computerized Fireworks Shooting System from Pyrotechnics Management, Inc., State College, Pa., provides 12 volts for testing continuity (that is, presence of either an ignitor 4 or a lift e-match 5) and 24 volts for firing the ignitor 4 or lift e-match 5. Resistors R13 and R14 form a resistor divider to detect the 24-volt firing signal. Resistors R4 and R5 form a second resistor divider that detects a successful launch by removal of the input voltage. Diode D9 and resistor R15 provide clamping to ensure that the input pin that detects power loss (microprocessor U1 pin 11) does not become damaged when the input voltage increases to 24 volts to signal the fire command. Q3 is a crystal that provides increased accuracy over the resistor-capacitor oscillator of the FIG. 6 circuit. Capacitors C1 and C2 are required by the internal crystal oscillator of microprocessor U1. Resistors R2 and R3 provide a resistor divider that is used to measure the voltage on capacitor C4, the energy storage element 42. Upon receipt of a fire command, microprocessor U1 checks that the voltage on capacitor C4 is sufficient to provide enough energy to ignite break e-match 6 before igniting lift e-match 5. The schematic of FIG. 8 thus represents an ignitor 4 that provides increased safety and timing accuracy but does not use extensive communication capability. Thus FIG. 8 describes an ignitor that appears more like a conventional electric match but with increased safety and timing accuracy.

What is claimed is:

1. A method for firing a pyrotechnic projectile, the method comprising the steps of:

providing an ignitor for the pyrotechnic projectile, the projectile comprising a lift charge to be ignited by an electrically operated lift charge ignition device to launch the pyrotechnic projectile, and a break charge to be ignited by an electrically operated break charge ignition device to burst the pyrotechnic projectile, the igniter comprising electronic control circuitry adapted to be carried by the pyrotechnic projectile and for receiving an electronic fire command from an external control device and, in response thereto, (1) activating the electronically operated lift charge ignition device so as to launch the pyrotechnic projectile and the igniter, and (2) a pre-determined time after receiving the electronic fire command, activating the electronically operated break charge ignition device so as to burst the pyrotechnic projectile;

sending a "fire" command to the pyrotechnic projectile so as to activate the lift charge;

upon receiving confirmation of a successful launch, electrically timing the predetermined time within the pyrotechnic projectile; and upon expiration of the predetermined time, detonating the break charge carried by the pyrotechnic projectile.

2. A method according to claim 1 wherein, upon failure to detect the launch confirmation, deactivating the projectile.

3. A method according to claim 1 further comprising:

prior to sending the "fire" command to the pyrotechnic projectile, sending a calibration signal to the pyrotechnic projectile and, upon receiving confirmation of proper calibration, sending the "fire" command to the pyrotechnic projectile.

4. A method according to claim 1 further comprising:

prior to sending the "fire" command to the pyrotechnic projectile, sending an "arm" command to the pyrotechnic projectile and, upon receiving confirmation of the armed status of the pyrotechnic projectile, sending the "fire" command to the pyrotechnic projectile.

5. A method according to claim 1 wherein the magnitude of the predetermined time is pre-programmed into the pyrotechnic projectile.

6. A method according to claim 1 wherein the magnitude of the predetermined time is programmed into the pyrotechnic projectile at a time of use.

* * * * *